United States Patent [19]

Nishikawa et al.

[11] Patent Number: 5,074,185

[45] Date of Patent: Dec. 24, 1991

[54] ENVELOPE-GENERATING APPARATUS IN ELECTRONIC MUSICAL INSTRUMENT

[75] Inventors: Masashi Nishikawa; Fumio Rokkaku; Satoshi Otsuka; Mitsuhiro Umeta, all of Hamamatsu, Japan

[73] Assignee: Roland Corporation, Osaka, Japan

[21] Appl. No.: 487,728

[22] Filed: Mar. 5, 1990

[51] Int. Cl.[5] ..... G10H 1/057

[52] U.S. Cl. ..... 84/627; 84/663

[58] Field of Search ..... 84/614, 617, 618, 627, 84/633, 653, 655, 656, 663, 665, 702, 711

[56] References Cited

U.S. PATENT DOCUMENTS

| | | | |
|---|---|---|---|
| 4,649,783 | 3/1987 | Strong et al. | 84/606 |
| 4,909,120 | 3/1990 | Horiki et al. | 84/627 |
| 4,928,569 | 5/1990 | Kudo et al. | 84/626 |

*Primary Examiner*—William M. Shoop, Jr.
*Assistant Examiner*—Brian Sircus
*Attorney, Agent, or Firm*—Beveridge, DeGrandi & Weilacher

[57] ABSTRACT

An envelope-generating apparatus for an electronic musical instrument is disclosed. The apparatus which generates an envelope signal for a musical tone includes a rate detector for detecting the actual rate-of-change of the envelope signal at an instant before quick-attenuation of the signal is to commence, and a quick-attenuation controller for first setting a predetermined attenuation rate for the envelope signal based on the actual rate-of-change detected by the rate detector and thereafter controlling quick-attenuation of the envelope signal. The apparatus further could include a level detector for detecting an actual envelope signal level at an instant before quick-attenuation commences. Also, in place of the rate detector, a musical pitch-detector for detecting the actual pitch of a musical tone being generated could be provided, or a characteristics-detector for detecting musical tone characteristics of a newly generated tone, or volume-detector means for detecting the total tone volume of all musical tones being generated could be provided. Such different detectors provide different data utilized by the apparatus or instrument to optimize the quick-attenuation process by accelerating it without causing any noticeable click noise.

9 Claims, 12 Drawing Sheets

FIG. 2

| T | RTB |
|---|---|
| 0 | − 4 |
| 1 | − 8 |
| 2 | − 16 |
| 3 | − 32 |
| 4 | − 64 |
| 5 | −128 |
| 6 | − 256 |

FIG. 13

| TIMBRE | RATE-MODIFYING COEFFICENTS |
|---|---|
| A | 1.0 |
| B | 1.5 |
| C | 1.2 |
| D | 0.8 |
| | |

FIG. 3A

| | | | |
|---|---|---|---|
| 1 | T(1) | RATE(1) | DPF(1) |
| 2 | T(2) | RATE(2) | DPF(2) |
| | | | |
| 9 | T(9) | RATE(9) | DPF(9) |
| 10 | T(10) | RATE(10) | DPF(10) |

FIG. 3B

| KEY SORT | KEY Nos. | CHANNEL Nos. |
|---|---|---|
| "U" UPPER BLOCK OF KEYBOARD | 48 | — |
| | 49 | — |
| | ... | ... |
| | 95 | — |
| | 96 | — |
| "L" LOWER BLOCK OF KEYBOARD | 36 | — |
| | 37 | — |
| | ... | ... |
| | 83 | — |
| | 84 | — |

ENVELOPE-GENERATING APPARATUS IN ELECTRONIC MUSICAL INSTRUMENT

BACKGROUND OF THE INVENTION

The invention relates to an envelope-generating apparatus which is incorporated in an electronic musical instrument and adapted to generate envelope signals for musical tones, and more in particular, the invention relates to a system wherein quickly weakened or attenuated are some of the musical tones which are being generated but need not or should not continue because musical timbre is changed during a musical performance, or because there is no channel which is free to be allotted to a newly depressed key. The invention also relates to an electronic musical instrument which comprises a plurality of musical tone-generating channels and is so constructed that at least one of the channels can be selected for generation of a new musical tone even while all the channels are generating musical tones.

Some technical terms including "rate" are repeatedly used in this invention so that definitions thereof are given at first as follows:

(a) the word "rate-of-change", or "rate" in brief, means a rate of change per unit time in intensity of the envelope signals, including positive and negative rates;

(b) the word "positive rate" denotes a rate of "increase" per unit time in the intensity of the envelope signals wherein, for example, "greater positive rate" produces a shorter rise time (or sharper leading edge) of fthe envelope signal; and (c) the word "negative rate" which is a minus value denotes a rate of "decrease" per unit time in the intensity of the envelope signals wherein "greater negative rate" results in quicker attenuation of the envelope signals, thus the adjective "great" or "greater" being used in the sense of "absolute value" of the "negative rate".

It is desirable in the quick-attenuation processing that musical tone attenuation is completed as quickly as possible without causing the so-called click noise. A negative rate at which an intensity or level of envelope signal decreases or decays must be greater for quicker attenuation. On the contrary, the negative rate should be smaller in order not to give rise to the click noise.

A method proposed to meet these two conflicting requirements is disclosed in the Japanese Patent Publication Tokkaisho 62-111290 wherein a predetermined initial negative rate of attenuation is given to a musical tone which is being generated, whatever actual rate-of-change of envelope signal might be found at an instant when the quick-attenuation processing commences. A predetermined greater negative rate for quicker attenuation is imparted to the envelope signal after an actual level thereof has been damped at the predetermined initial negative rate to become lower than a given level.

In known electronic musical instruments which comprise a plurality of musical tone-generating channels, a new musical tone is assigned in general to one of the channels which corresponds to such a musical tone for which attenuation has progressed furthest after key-release, if all of the channels are generating musical tones.

In the known method as mentioned above, the negative rate for attenuation is predetermined and fixed independent upon the actual rate-of-change of envelope signal effective at the instant when the quick-attenuation processing commences. Therefore, it is a common practice that the predetermined negative rate for attenuation of envelope signal is made as lower as possible so as to avoid any sudden change in the rate-of-change whereby any click noise or increase thereof is prevented from taking place. This inevitably leads to a problem such that it takes a considerably long time for the quick-attenuation to be completed.

Further, there is a possibility that the actual negative rate for attenuation of envelope signal which rate is effective at the instant when the quick-attenuation processing commences is greater than the predetermined negative rate. In such a case, the time necessary for quick-attenuation will be prolonged disadvantageously because the greater actual negative rate is reduced to the predetermined smaller negative rate.

It is also noted that the known manner wherein the new musical tone is assigned to the one channel corresponding to the current musical tone for which attenuation has progressed furthest after key-release, does not necessarily mean a proper manner in which the attenuation finishes most quickly without causing a click noise or increase thereof. In other words, there may be another channel which is not selected in such a known manner but is more suited for noiseless quick-attenuation to progress fastest.

SUMMARY OF THE INVENTION

It is, therefore, an object of the invention to resolve the problems inherent in prior art by providing an envelope-generating apparatus in an electronic musical instrument, or the latter instrument per se, which is adapted to finish quick-attenuation of musical tones within a short period of time and nevertheless without causing any significant click noise or any increase thereof.

An envelope-generating apparatus in an electronic musical instrument according to the invention has such a structure as adapted to generate an envelope signal of a musical tone and comprises:

(a) rate detecting means for detecting an actual rate-of-change of the envelope signal at an instant when quick-attenuation commences in respect of the musical tone; and (b) quick-attenuation controlling means for setting a predetermined negative rat for attenuation of the envelope signal based on the actual rate-of-change which is detected by the rate detecting means and for conducting quick-attenuation of said envelope signal.

It will be apparent that in the envelope-generating apparatus in the invention the predetermined negative rate is allotted to the envelope signal for attenuation thereof based on the actual rate-of-change which is effective at the instant when quick-attenuation commences. Consequently, the negative rate allotted in such a manner is never smaller than said actual negative rate detected at said instant whereby quick-attenuation of said envelope signal can progress faster to finish quickly free from any unpleasant click noise or any increase thereof.

The envelope-generating apparatus in the invention may comprise, for the purpose of much faster quick-attenuation, the following additional features: namely, (1) level detecting means for detecting an actual level or intensity of the envelope signal at an instant when quick-attenuation commence in respect of the musical tone, wherein the quick-attenuation controlling means sets a predetermined negative rate for attenuation of the envelope signal such that quick-attenuation of said level is much more accelerated if the actual level detected by the level detecting means is lower than a reference level; or (2) the quick-attenuation controlling means repeatedly replaces current predetermined negative rate with another greater negative rate for attenuation of the envelope signal in such a manner that quick-attenuation of said level is gradually accelerated more and more in course of time.

The envelope-generating apparatus generating an envelope signal of musical tone in the invention may, for much faster quick-attenuation free from click noises, be constructed in the following manners: namely, (1) a manner wherein said apparatus comprises:

(a) musical pitch-detecting means for detecting an actual musical pitch of musical tone which is being generated; and (b) quick-attenuation controlling means for setting a predetermined negative rate for attenuation of the envelope signal such that quick-attenuation of a level of said envelope signal is accelerated if the actual musical pitch is higher than a reference musical pitch: or (2) a manner wherein said apparatus comprises:

(a) characteristic-detecting means for detecting characteristics of a musical tone which is to be generated newly; and (b) quick-attenuation controlling means for setting a predetermined negative rate for attenuation of the envelope signal which is being generated, based on the characteristics detected by the characteristic-detecting means: or (3) a manner wherein said apparatus comprises:

(a) musical volume-detecting means for detecting an actual total volume of all musical tones which are being generated; and (b) quick-attenuation controlling means for setting a predetermined negative rate for attenuation of the envelope signal such that the higher the actual total volume, the quicker a level of the envelope signal is attenuated.

In order to resolve the abovementioned problems, the invention provides also an electronic musical instrument which comprises a plurality of musical channels and is so constructed that at least one of the channels can be selected for generation of a new musical tone even while all the channels are generating musical tones in accordance with respective envelope signals, wherein the electronic musical instrument comprises:

(a) character-detecting means for detecting characteristics of musical tones which ar being generated respectively by the musical channels;

(b) rate searching means for searching negative rates for attenuation of the envelope signals of said musical tones based on the characteristics thereof detected by the characteristic detecting means;

(c) time determining means for determining time length required for attenuation of the respective musical tones, based on the negative rates searched by the rate searching means; and (d) channel selecting means for selecting one of the musical channels which is judged to be generating the musical tone of the shortest time length of attenuation, based on the data of time length determined by the time determining means.

The electronic musical instrument which selects such a channel as corresponding to the shortest time length of attenuation thus enables attenuation to be completed quickly and free from click noises.

BRIEF DESCRIPTION OF THE DRAWINGS

The invention will become more apparent from the detailed description and the accompanying drawings, wherein:

FIGS. 1 to 8 illustrate an electronic musical instrument in a first embodiment of the invention, in which;

FIG. 1 is a block diagram;

FIGS. 2, 3A and 3B respectively show a rate data table which is stored in a ROM, a channel table and a key map which are stored in memory areas provided in a RAM;

FIGS. 4 to 7 are flowcharts of a main routine, a quick-attenuation routine, a timer-interrupt routine and an envelope-interrupt routine, respectively;

FIG. 8 is a waveform diagram of envelope signals;

FIGS. 11 to 14B illustrate still another electronic musical instrument in a third embodiment of the invention, in which;

FIG. 11 is a flowchart of a quick-attenuation routine which corresponds to those routines shown in FIGS. 5 and 9, respectively;

FIG. 12 is a graph illustrating a relationship between key Nos. and rate-modifying coefficients;

FIG. 13 shows a relationship between musical timbres and rate-modifying coefficients stored in a memory area of a ROM;

FIGS. 14A and 14B are graphs showing relationships between key-depression speed and the rate-modifying coefficients for a timbre "A" and for another timbre "B", respectively.

DESCRIPTION OF THE PREFERRED EMBODIMENTS

Figure 1:
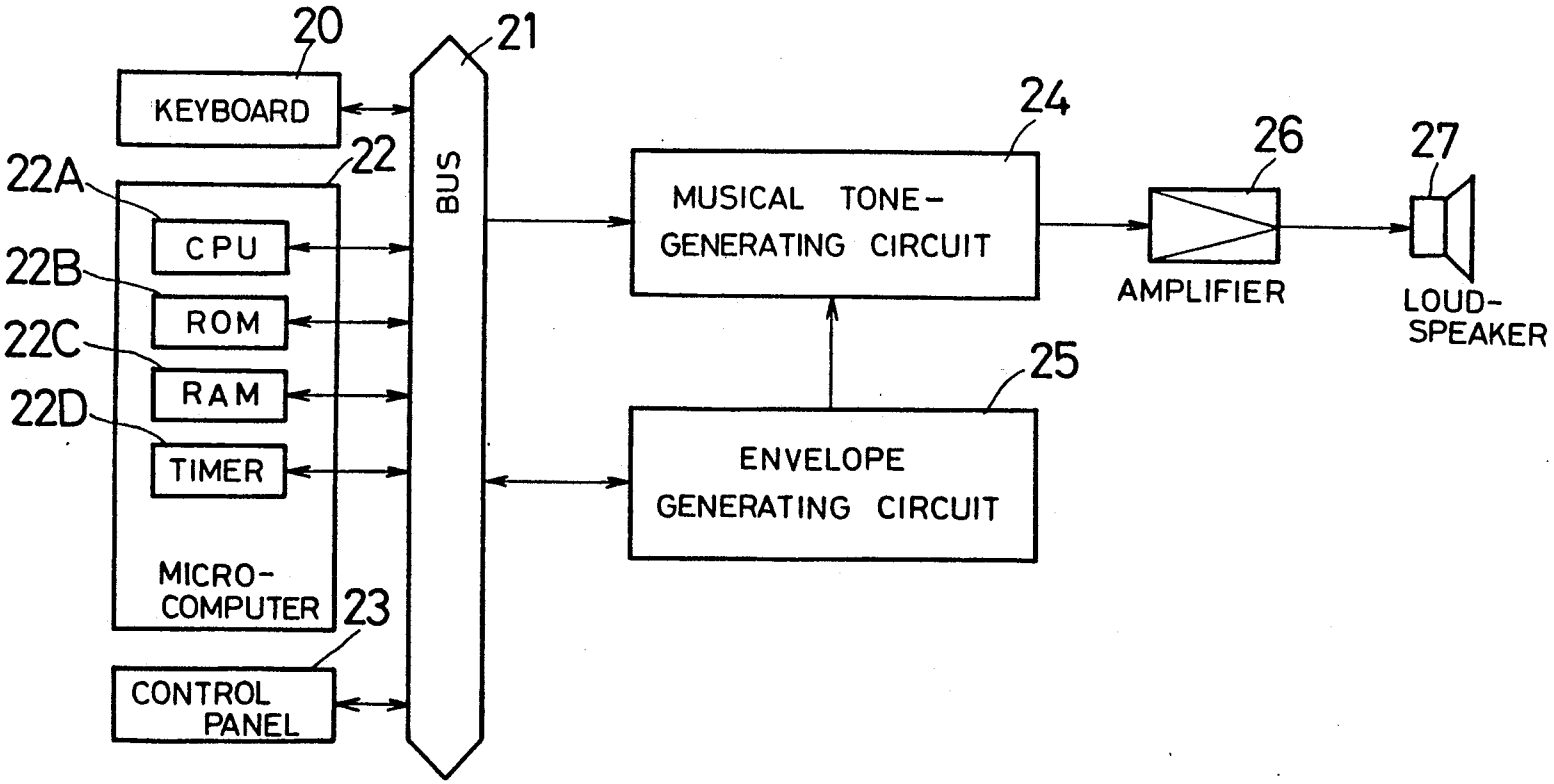

Preferred embodiments of the invention will now be described in detail referring to the drawings.

[First Embodiment]

In FIG. 1 illustrating in outline a first embodiment, the numeral 20 denotes a keyboard which comprises an upper block of keys giving a compass covering C3 to C7, a lower block of keys giving another compass covering C2 to C6 as well as a key operation-detecting circuit.

Depression or release of the keys included in the upper or lower blocks of the keyboard 20 causes the key operation-detecting circuit to produce "key data" comprising: key sort information "UL" indicating whether an operated key belongs to the upper block or to the lower block; key number information "KN" indicating which key in the upper or lower block is operated; key state information "PR" indicating whether the operated key was depressed or released; and key speed information "V" indicating a speed at which the key was depressed or released.

The key operation-detecting circuit causes an interrupt processing to be executed by a microcomputer 22, when said circuit detects a change in key conditions including depression and release. In detail, such a command signal is given via a bus 21 to a central processing unit (CPU) 22A which constitutes the microcomputer 22 and conducts predetermined programs.

A control panel 23 comprises: a timbre selecting switch which enables selection of timbres different between the upper and lower block of the keyboard; a switch operation-detecting circuit which produces timbre numbers "TN" corresponding to the timbres selected by the switch; and an indicator for indicating names of the selected timbres. The timbre numbers "TN" produced by the switch operation-detecting circuit are input into the CPU 22A under control thereof through the bus 21, and at the same time the names of selected timbres are displayed on the indicator also under control of said CPU 22A.

The microcomputer 22 having the CPU 22A further comprises: a read-only memory (ROM) 22B in which some programs, tone data and tables used during execution of the programs are written; a random-access memory (RAM) 22C which serves as a working memory and includes memory areas allotted to various registers, flags, first-in-first-out memories or buffers (FIFO) and other maps necessary for execution of said programs; and a timer 22D which causes timer-interrupts in the CPU 22A at regular intervals of 2 milliseconds (mS), the CPU thereby being forced to conduct predetermined timer-interrupt processings.

The key operation-detecting circuit of the keyboard 20 also causes the CPU 22A to execute the other kind of interrupt processings in response to any change in key condition, as follows. The CPU 22A receives from said key operation-detecting circuit the "key data" of a key which is being or has been operated to change its condition, and the "key data" enter key data-FIFO formed at a given area in the RAM 22C. The CPU 22A then executes the programs based on the "key data" which have entered the FIFO and include the key sort information "UL", the key number information "KN", the key state information "PR" and the key speed information "V", also based on the timbre numbers "TN" which are delivered from the switch operation-detecting circuit.

The CPU 22A controls musical tone-generating circuit 24 which produces musical tone signals. An envelope generating circuit 25 producing envelope signals which are fed to the musical tone-generating circuit 24 so as to form amplitudes of the musical tone signals produced therein is also controlled by the CPU 22A. The musical tones which are controlled in this way and produced in said circuit 24 are output as audible sounds from a loudspeaker 27, after being amplified in an amplifier 26.

Ten (10) tone generating channels constitute the musical tone-generating circuit 24 so that it can simultaneously produce ten (10) musical tone signals at the same time based on tone control data from the CPU 22A. Ten (10) envelope generating channels which respectively correspond to the ten tone generating channels in a one-to-one manner constitute the envelope generating circuit 25. Envelope controlling data each comprising a "target value" and "rate-of-change data" from the CPU 22A cause the ten envelope generating channels to produce different envelope signals which are respectively given to different tone generating channels. These different envelope signals are also fed to the CPU 22A through the bus 21. One tone generating channel and one envelope generating channel which are in a one-to-one relationship will be referred to hereinafter as a "channel pair".

The "target value" mentioned above is a target level of each envelope signal which changes in its level or intensity in course of time. The "rate-of-change data" also mentioned above is a rate of change per unit time in the level of envelope signal. The envelope generating circuit 25 is supplied with pairs of such target values and rate-of-change data, each of these pairs representing a desired waveform of an envelope signal and corresponding to the "channel pair". Each of the envelope generating channels in said circuit 25 is constructed to sum up at regular time intervals the rate-of-change data which have been given thereto, in order to produce the envelope signal which change changes in level in the course of time.

An interrupt command is given to the CPU 22A when the level of the envelope signal produced in this way has reached the target value. The CPU 22A then performs a predetermined envelope-interrupt processing including the allotting of next envelope controlling data to the envelope generating channel in which said level of the envelope signal has reached said target value. Any other interrupt processing is deferred until one interrupt processing ends.

Next, reference is made to FIG. 2 which illustrates a rate data table listing negative rates and stored at a given area of the ROM 22B.

This table is utilized to adopt proper data of negative rates for execution of quick-attenuation. Negative rates "RTB" of −4, −8, −16, −32, −64, −128 and −256 are assigned to the reference numerals "T" of 0 to 6, respectively. Each negative rate "RTB" defines a degree of change per 2 milliseconds in the envelope signal level which change occurs in the envelope generating circuit 25 within a range from 0 to 100. Taking "−8" as an example of the negative rates "RTB", the level of envelope signal will decrease by "8" in 2 milliseconds.

FIGS. 3A and 3B respectively show a channel table and a key map as described below.

(*) Channel table ( FIG. 3A )

This table contains: reference codes T(1) to T(10) which correspond to the channel pairs and are used to make reference to the rate data table when quick-attenuation is executed: rates-of-change "RATE(1)" to "RATE(10)" which are used to produce the envelope signals; and flags "DPF(1)" to "DPF(10)" to which "1" is set when the relevant channel pair is undergoing a quick-attenuation.

() Key map ( FIG. 3B** )

Key Nos. "KN" of 48 to 96 are assigned to the keys on the upper block of keyboard, with "KN" of 36 to 84 assigned to the other keys on the lower block of the keyboard wherein all of these keys bearing "KN" of 36 to 96 as a whole constitute a compass covering the range of musical tones C2 to C7. Channel number areas are assigned to the respective key Nos. "KN", in which areas channel numbers are to be written. If there is any key No. for which no channel pair is used, then "0" is written to its channel number area.

Figure 4:
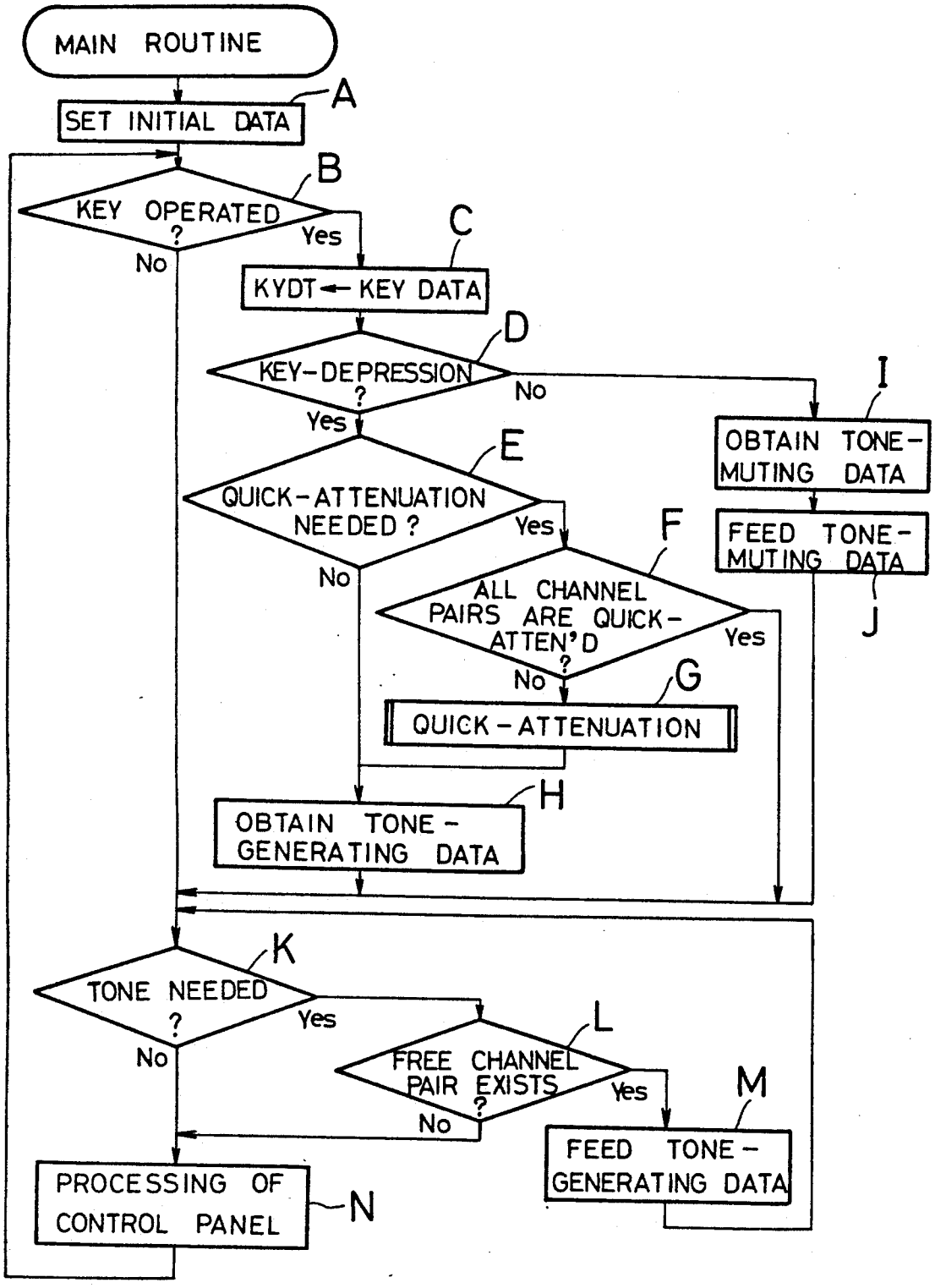

Basic operation of the electronic musical instrument in this embodiment will now be described referring to a flowchart of main routine given in FIG. 4.

Step A: By turning on a power switch, the initial setting of the keyboard 20, RAM 22C, timer 22D, control panel 23, musical tone-generating circuit 24 and envelope generating circuit 25 is conducted to start to execute the predetermined programs.

Step B: A decision is made as to whether a new key depression or new key release has or has not been made, by deciding whether any key data does or does not exist in the key data-FIFO.

Step C: If "Yes" is the decision at Step B, then the key data is removed from the key data-FIFO and is called "temporary key data" (KYDT).

Step D: A decision is made on whether the temporary key data "KYDT" does or does not correspond to any key depression.

Step E: If "Yes" is the decision at Step D, a further decision is made on whether any channel pair need or need not undergo quick-attenuation, in other words, whether all of the channel pairs are or are not working to generate musical tones. This decision at this Step E is carried out by deciding whether a sum of a free channel number "IDNUM" indicating the number of channel pairs not generating musical tones and a quick-attenuation channel number "DPNUM" indicating the number of channel pairs undergoing quick-attenuation is or is not less than a demanded-tone number "DMNUM" indicating the number of musical tones which need to be generated at that instant.

Step F: If the decision at Step E shows that any channel pair is to be subjected to quick-attenuation, then a further decision is made as to whether the quick-attenuation channel number "DPNUM" is or is not equal to "10", i.e., the total number of the channel pairs. If there is a "Yes" at this decision, then any musical tone is not generated for the new key depression and the process goes to Step K, because all of the channel pairs are undergoing quick-attenuation at that instant.

Step G: Quick-attenuation Routine

Figure 5:
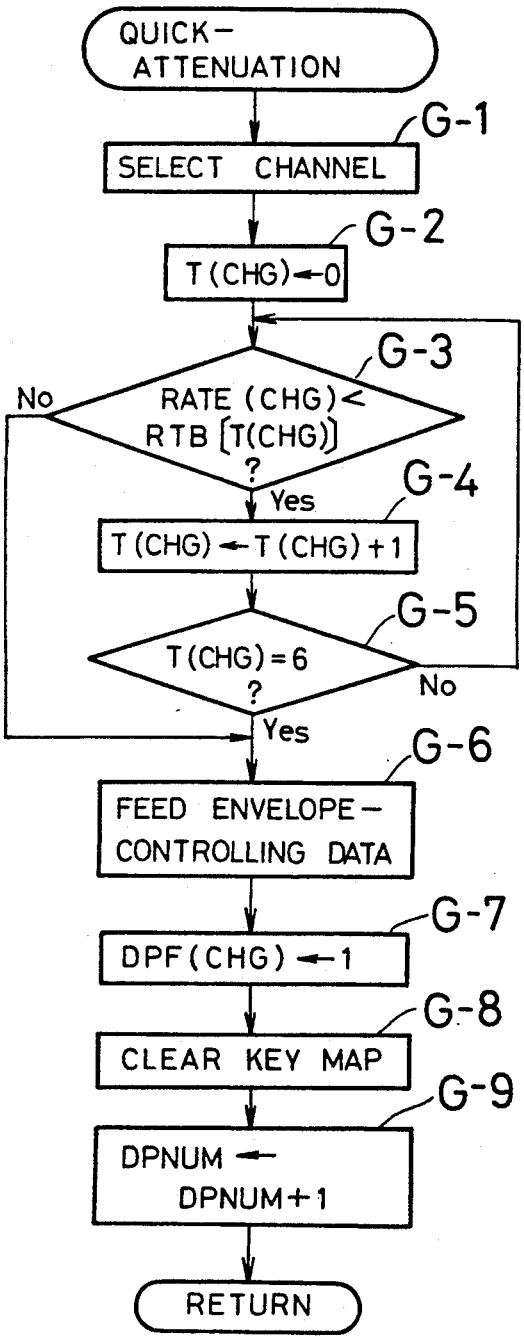

Details of this routine will be given hereinafter by means of a flowchart shown in FIG. 5. Any other interrupt processing is deferred to an end of this routine at Step G.

Step H: The temporary key data "KYDT" indicating an existence of the new key depression is used together with the tone data indicating the timbre selected for the relevant key, so that they form a tone-generating data which controls the musical tone-generating circuit 24 and the envelope generating circuit 25. The tone generating data enters a tone-requiring FIFO together with the key sort information "UL" and the key number information "KN". The tone requiring FIFO comprises ten (10) areas which correspond to the number of all channel pairs and is of an imaginary ring-like shape. The tone generating data is composed of the tone controlling data and the envelope controlling data which correspond to a demand to generate a musical tone. Further at this step H, "1" is added to the demanded-tone number "DMNUM" for an incremental increase thereof.

Step I: If it is found at Step D that the temporary key data "KYDT" is not for any key depression but for a new key release, then tone muting data is produced based on such temporary key data "KYDT" so that the musical tone-generating circuit 24 and the envelope generating circuit 25 are controlled to mute the musical tone which has been generated by the newly released key.

Step J: One channel number area as shown in FIG. 3B is selected according to the key sort information "UL" and the key number information "KN" which are included in the temporary key data "KYDT". The channel number is read from said selected area so that the tone muting data produced at Step I is supplied to the channel pair carrying said channel number and composed of relevant channels in the musical tone-generating circuit 24 and envelope generating circuit 25. The muting of the musical tone is carried out in this way. If "0" is found at that the selected area, then the tone muting data is not given to any channel pair because there is no channel pair which is in use at that instant for the newly released key.

Step K: A decision is made as to whether any musical tone is or is not required, based on the existence or absence of any tone requiring data in the tone requiring FIFO.

Step L: If there is a "Yes" at the decision made at Step K, a further decision is made as to whether there is or is not any free channel pair, based on the existence or absence of any free channel data in a free channel-FIFO. This free channel-FIFO receives the channel numbers of channel pairs which are not operating for generation of musical tones, and is so constructed that ten (10) areas corresponding to the total number of channel pairs form an imaginary ring.

Step M: If it is confirmed at Step L that there is any free channel pair, then the tone generating data is given to the musical tone-generating circuit 24 and the envelope generating circuit 25 in order to generate a required musical tone. In more detail, the free channel data indicating the ordinal number of the free channel is removed from the free channel-FIFO and is called the "free channel number CHM". Then the relevant tone generating data is removed from the tone requiring FIFO so as to be fed to the channel pair which corresponds to the free channel number "CHM" and is composed of channels of the musical tone-generating circuit 24 and the envelope generating circuit 25. Further, positive rates of the envelope signal included in the tone generating data is written in the rate area (of channel table shown in FIG. 3A) denoted by "RATE(CHM)" which corresponds to the free channel number "CHM". This free channel number "CHM" is also written in the channel number area (of the key map shown in FIG. 3B) which corresponds to the key sort information "UL" and key number information "KN" included in the temporary key data "KYDT". In addition, "1" is subtracted from the free channel number "IDNUM" and from the demanded-tone number "DMNUM", for decrementing thereof.

Step N: Here read is the timbre number "TN" indicating the timbre which is selected by operating the timbre selecting switch on the control panel 23. A changeover to new tone data will be made if said timbre number "TN" is found to have been changed indicating an operation of said switch. And, the name of newly selected timbre is displayed on the control panel 23, which is updated in this way.

The quick-attenuation routine at Step G is now explained in detail with reference to FIG. 5.

Step G-1: In a case where any channel pairs for which "0" appears on relevant flags "DPF(1)" to "DPF(10)" indicating that said channel pairs are not undergoing quick-attenuation, levels "LEVEL" of the envelope signals for said channel pairs are read from the envelope generating circuit 25. One channel pair which has a minimum value of the level "LEVEL" is selected to be subject to quick-attenuation. Then, a channel number "CHG" is given to the selected channel.

Step G-2: The reference code "T(CHG)", which is used to make a reference to the rate data table (shown in FIG. 2) and corresponds to the selected channel "CHG", is cleared with "0".

Step G-3: A decision is made as to whether current rate-of-change data "RATE(CHG)" of the envelope signal (which corresponds to the selected channel number "CHG" in the channel table shown in FIG. 3A) is or is not lower than a negative rate "RTB[T(CHG)]" which is found on the rate data table in FIG. 2 and corresponds to the reference code "T(CHG)". The negative rate "RTB[T(CHG)]" referred to at this Step G-3 is not an "absolute" value but a "real" number. It is noted that the memory area for rate-of-change data "RATE (CHG)" always carries the newest rate-of-change data of envelope signals since each rate-of-change data is written in said area at the same time as it is fed to the envelope generating circuit 25 at Step M (when generation of musical tones commences) or in such an envelope processing (during generation of musical tones) as described below.

Step G-4: If there is a "Yes" at the decision made at Step G-3, then "1" is added to the reference code "T(CHG)" indicating the selected channel "CHG", to thereby effect an incremental increase thereof.

Step G-5: A further decision is made on whether the reference code "T(CHG)" indicating the selected channel "CHG" is or is not equal to "6".

The abovementioned Steps G-1 to G-5 are executed to select such negative rate data "RTB[T(CHG)]" which is approximate to, but is lower than, the rate-of-change "RATE(CHG)" of the envelope signal as found at an instant when a quick-attenuation processing commences. In other words, such a selected negative rate "RTB[T(CHG)]" accelerates the quick-attenuation process. The negative rate data "RTB[T(CHG)]" referred to here is also the "real" number as stated at Step G-3.

Step G-6: The negative rate "RTB[T(CHG)]" which is found on the rate data table in FIG. 2 in correspondence with the reference code "T(CHG)" which in turn corresponds to the selected channel "CHG" is given, as the negative rate data of envelope signal, to a relevant envelope generating channel in the envelope generating circuit 25.

Step G-7: A value "1" indicating quick-attenuation is written on an area in the channel table shown in FIG. 3A, the area being the flag "DPF(CHG)" which corresponds to the selected channel "CHG".

Step G-8: A value "0" is written on an area in the key map shown in FIG. 3B, the thus cleared area being the channel number area which relates to a key corresponding to the selected channel "CHG".

Step G-9: "1" is added to the quick-attenuation channel number "DPNUM" to thereby effect an incremental increase thereof.

Now described are the interrupt processings which include the timer-interrupt processing and the envelope-interrupt processing.

Figure 6:
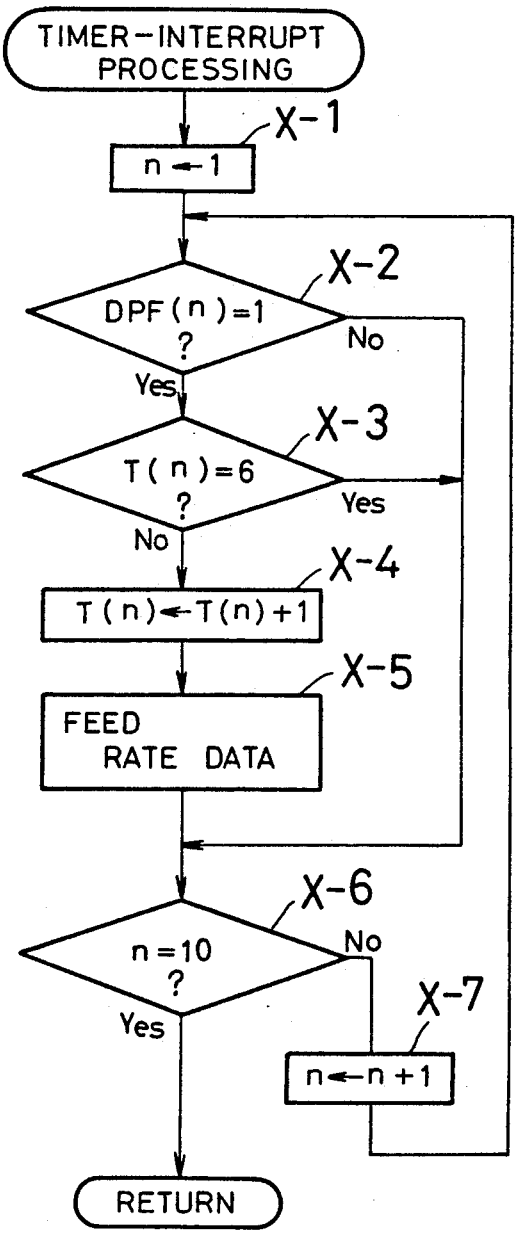

(*) Timer-Interrupt Processing ( FIG. 6 )

This routine is executed by the CPU 22A in response to each of the timer interrupt commands which are produced by the timer 22D at regular intervals of 2 milliseconds.

Step X-1: "1" is set to a channel number "n" which indicates the ordinal numbers of the channel pairs.

Step X-2: A decision is made as to whether or not a value carried by the flag "DPF(n)" which corresponds to the channel number "n" and included in the channel table (shown in FIG. 3A) is "1". This means that a decision on whether the channel pair of the channel number "n" is or is not undergoing quick-attenuation.

Step X-3: If "Yes" at the decision made at Step X-2, a further decision is made as to whether the reference code "T(n)" is or is not "6".

Step X-4: If "No", then "1" is added to said reference code "T(n)" so as to effect an incremental increase thereof.

Step X-5: The negative rate "RTB[T(n)]" which is found on the rate data table in FIG. 2 in correspondence with the reference code "T(n)" is given, as the negative rate data of envelope signal, to a relevant envelope generating channel in the envelope generating circuit 25.

Step X-6: A still further decision is made on whether the channel number "n" is or is not equal to "10", i.e., the total number of channel pairs.

Step X-7: If there is a "No at the decision made at Step X-6, then "1" is added to said channel number "n" so as to effect an incremental increase thereof.

Figure 8:
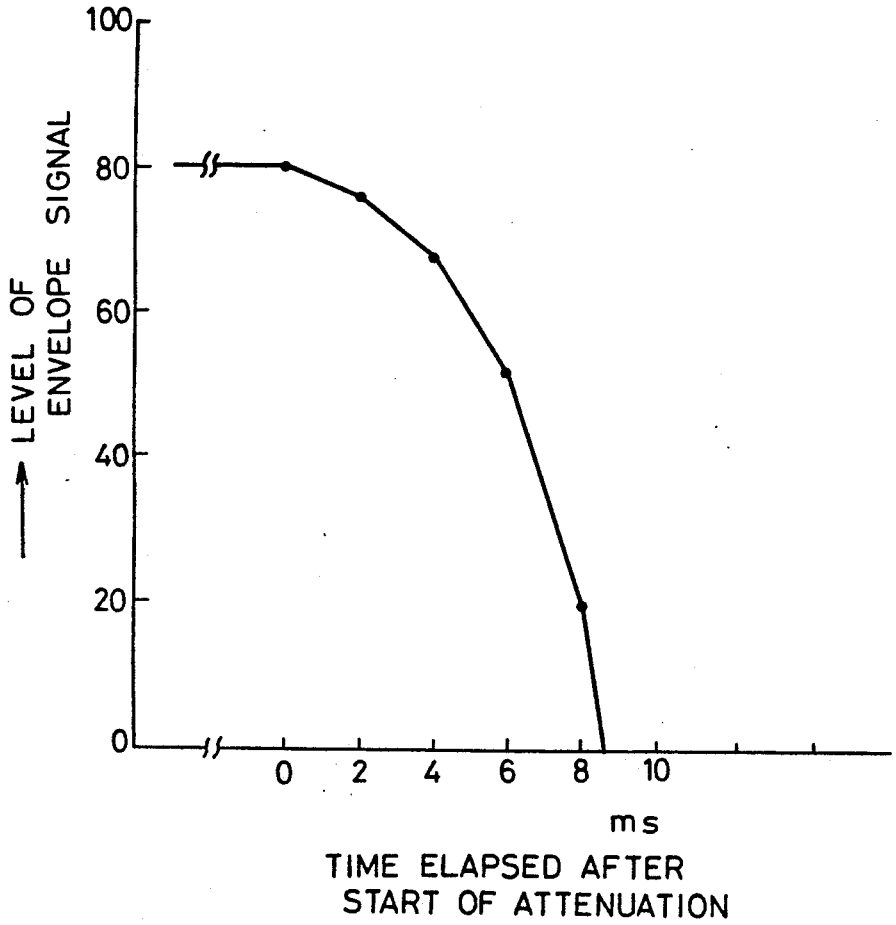

The timer-interrupt processing described above is such that the (absolute value of) negative rate of the envelope signal for each channel pair undergoing a quick-attenuation processing is made greater stepwise at regular time intervals in the course of time after commencement of said quick-attenuation processing. In other words, attenuation of the envelope signal level is gradually caused to progress faster and faster. Therefore, the envelope signal will produce such a waveform as shown in FIG. 8 if the level of said signal is, for instance, "80" with a rate-of-change of "0" at the beginning of quick-attenuation processing. The time elapsed from the beginning of quick-attenuation is given along the axis of the abscissa, and the level of the envelope signal is given along the axis of ordinate, in FIG. 8.

Figure 7:
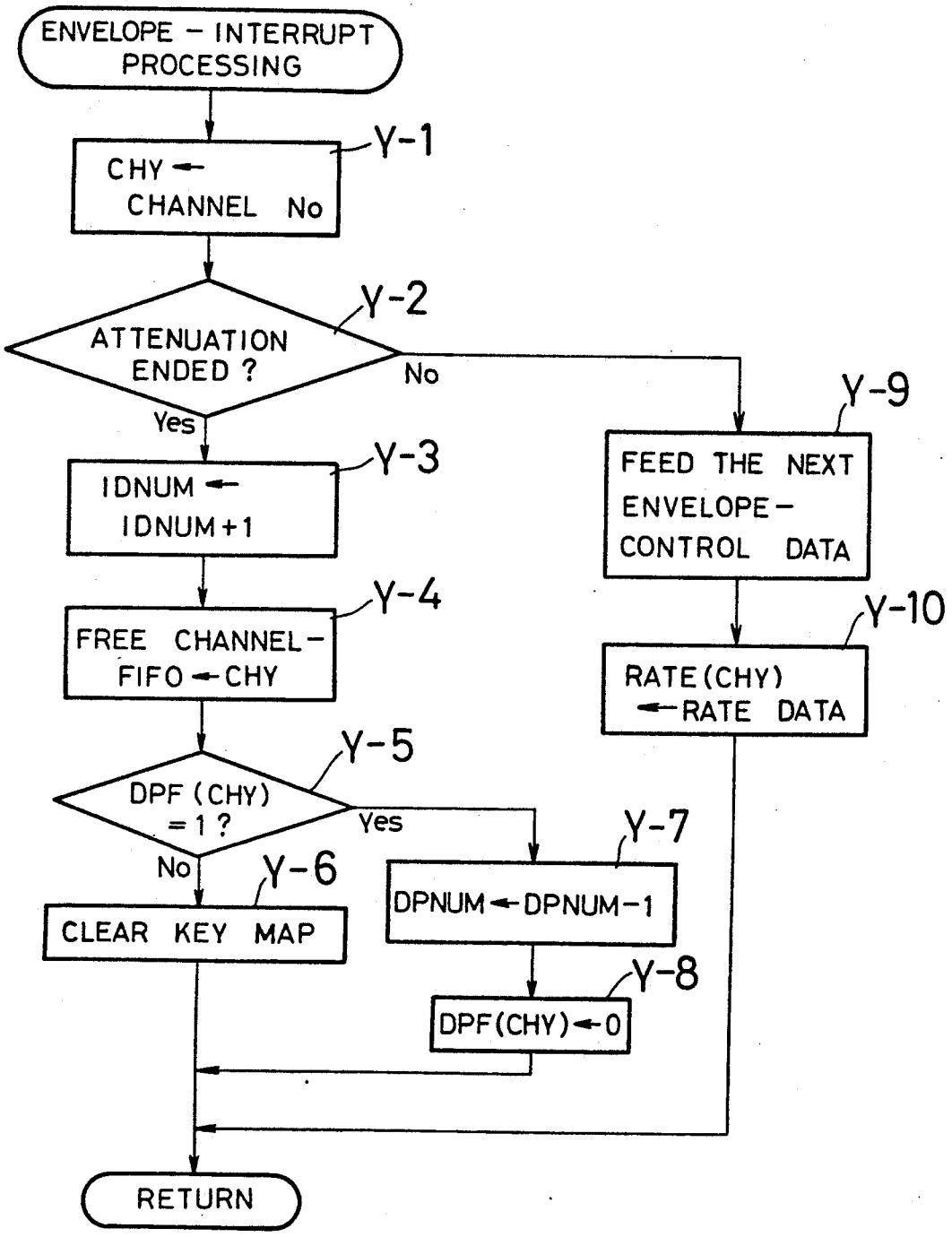

(**) Envelope-Interrupt Processing ( FIG. 7 )

This routine is executed by the CPU 22A in response to each interrupt command which is produced by the envelope generating circuit 25 when the level of envelope signal has reached the target value.

Step Y-1: Ordinal channel number of the channel pair for which the envelope signal level has reached the target value is read from the envelope generating circuit 25, and is hereinafter referred to as channel "CHY".

Step Y-2: The level "LEVEL" of said envelope signal corresponding to the channel pair of ordinal number "CHY" is read from said envelope generating circuit 25, and a decision is made as to whether or not said "LEVEL" is "0" indicating an end of attenuation.

Step Y-3: If "Yes", then "1" is added to the free channel number "IDNUM" indicating the number of free channels, thereby effecting incremental increase of said number "IDNUM".

Step Y-4: Subsequently, the channel number "CHY" indicating the channel pair for which attenuation has ended is caused to enter the free channel-FIFO.

Step Y-5: A further decision is made as to whether or not the flag "DPF(CHY)" corresponding to the channel "CHY" in the channel table in FIG. 3A is "1". This decision is made to know whether the attenuation process for the channel "CHY" as mentioned at Step Y-4 has been an accelerated (quick) attenuation ( i.e., "DPF(CHY)"=1) or an ordinary attenuation.

Step Y-6: If there is a "No" at the decision made at Step Y-5, then "0" is written in the channel number area of the key map (in FIG. 3B) so as to clear said area which has been used for the key corresponding to the channel "CHY" as mentioned at Step Y-4.

Step Y-7: If "Yes" at the decision made at Step Y-5, hat is, if "DPF(CHY)" is "1" indicating that the attenuation processing has been accelerated, then "1" is subtracted from the quick-attenuation channel number "DPNUM" thereby effecting decrement thereof.

Step Y-8: "0" is written in the flag "DPF(CHY)" which is an area corresponding to "CHY" and included in the channel table shown in FIG. 3A.

Step Y-9: If there is a "No" at the decision made at Step Y-2, then the next target value and rate-of-change data of the envelope signal are given to the envelope generating channel corresponding to the channel "CHY" in the envelope generating circuit 25. The next target value and rate-of-change data referred to above are determined according to the envelope waveform which in turn is determined based on the key data produced by key depression and on the tone data which has been selected.

Step Y-10: The rate-of-change data given to said envelope generating channel at Step Y-9 is written in the area "RATE(CHY)" which is an area corresponding to "CHY" and included in the channel table shown in FIG. 3A.

At Steps Y-9 and Y-10, an envelope controlling data adapted to produce a predetermined envelope waveform is given to the relevant envelope generating channel in said circuit 25, and the updated rate-of-change data is written in the area "RATE(CHY)" for the relevant channel pair.

[Second Embodiment]

In contrast with the first embodiment wherein the negative rate for attenuation of the envelope signal is set independently upon the level thereof found when quick-attenuation starts, this second embodiment is characterized in that said negative rate for attenuation of the envelope signal is given based on the level thereof which will be found when quick-attenuation starts. Therefore, the attenuation can be more accelerated in the second embodiment.

The same symbols and numerals as those in the first embodiment denote the same or corresponding members or parts, and description of such features that are common to the embodiments is not repeated. Here described are only quick-attenuation processing and timer-interrupt processing.

Figure 9:
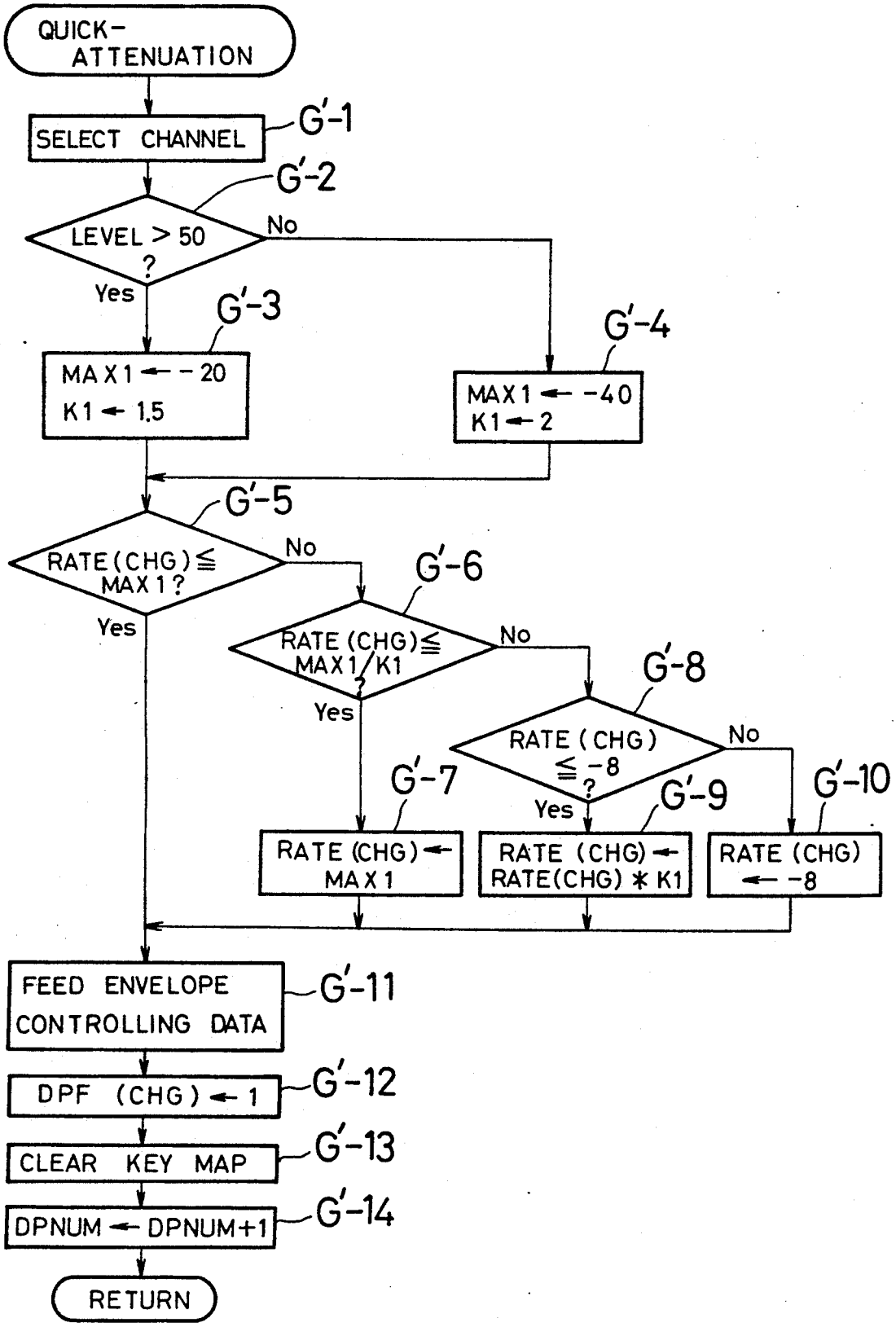
FIGS. 9 and 10 illustrate another electronic musical instrument in a second embodiment of the invention, and are flowcharts of a quick-attenuation routine and a timer-interrupt routine which correspond to the routines given in FIGS. 5 and 6, respectively.

(*) Quick-Attenuation Routine ( FIG. 9 )

Step G'-1: In a case where any channel pairs for which "0" appears on relevant flags "DPF(1)" to "DPF(10)" indicating that said channel pairs are not undergoing quick-attenuation, levels "LEVEL" of the envelope signals for said channel pairs are read from an envelope generating circuit 25. One channel pair which has a minimum value of the level "LEVEL" is selected to be subject to quick-attenuation. Then, a channel number "CHG" is given to the selected channel Step G'-2: A current level "LEVEL" of the envelope signal for the channel pair carrying the channel number "CHG" is read from the envelope generating circuit 25. A decision is then made as whether the envelope signal level "LEVEL" is higher than "50".

Step G'-3: If there is a "Yes" at the decision made at Step G'-2, then a value "−20" is adopted as a primarily-modified negative rate "MAX1" for the attenuation process, with a value "1.5" employed as a primary acceleration coefficient "K1".

Step G'-4: If there is a "No" at the decision made at Step G'-2, then another value "−40" is adopted as the primarily modified negative rate "MAX1", with another value "2" employed as the primary acceleration coefficient "K1".

It is to be noted regarding the Steps G'-1 to G'-4 that a musical tone whose current level is low does scarcely cause any noticeable or conspicuous click noise even if the tone were very quickly attenuated. In other words, a weak click noise of such a low level tone is masked well by other musical tones which are being generated. Therefore, the primarily-modified negative rate for the attenuation process and the primary acceleration coefficient are selected at those steps in such a manner that the attenuation process can progress as quickly as possible.

Step G'-5 A decision is made as to whether current rate-of-change data "RATE(CHG)" of the envelope signal for the channel pair corresponding to the selected channel "CHG" on the channel table shown in FIG. 3A is or is not either equal to or less than the primarily-modified negative rate "MAX1".

Step G'-6: If there is a "No" at the decision made at Step G'-5, then a further decision is made as to whether said rate-of-change "RATE(CHG)" is or is not either equal to or less than a quotient of "MAX1" divided by the primary acceleration coefficient "K1".

Step G'-7: If there is a "Yes" at the further decision made at Step G'-6, then the primarily-modified negative rate "MAX1" is written in an area for the "RATE(CHG)" which will be found on the channel table in FIG. 3A in correspondence with the selected channel "CHG".

Step G'-8: If there is a "No" at the further decision made at Step G'-6, then a still further decision is made as to whether the rate-of-change "RATE(CHG)" of the envelope signal for the channel pair corresponding to the selected channel "CHG" on the channel table shown in FIG. 3A is or is not either equal to or less than "−8".

Step G'-9: If there is a "Yes" at the still further decision made at Step G'-8, then a product of the primary acceleration coefficient "K1" and the rate-of-change "RATE(CHG)" corresponding to the selected channel "CHG" is written in the area for the "RATE (CHG)" which will be found on the channel table in FIG. 3A.

Step G'-10: If there is a "No" at the still further decision made at Step G'-8, then a value "−8" is written in the area for the "RATE(CHG)" on the channel table shown in FIG. 3A.

A processing executed at the Steps G'-5 to G'-10 is to sequentially compare the rate-of-change "RATE(CHG)" of envelope signal with the primarily-modified rate "MAX1" for the attenuation process, with the quotient thereof divided by the primary acceleration coefficient "K1", and then with "−8". It will be understood that such a processing enables selection of the greatest negative rate for the attenuation process as the rate-of-change "RATE(CHG)" which is effective at the start of the quick-attenuation process whereby the fastest acceleration is imparted thereto without bringing about any noticeable click noise or remarkable increase thereof.

Step G'-11: The rate-of-change "RATE(CHG)" found on the channel table in FIG. 3A and corresponding to the selected channel "CHG" is given, as the negative rate of envelope signal, to a relevant channel pair in the envelope generating circuit 25. Further, "0"

is given, as a target value of the envelope signal level, also to said relevant channel pair in said circuit 25.

Step G'-12: A value "1" indicating quick-attenuation is written on an area in the channel table shown in FIG. 3A, the area being the flag "DPF(CHG)" which corresponds to the selected channel "CHG".

Step G'-13: A value "0" is written on an area in the key map shown in FIG. 3B, the thus cleared area being the channel number area which relates to a key corresponding to the selected channel "CHG".

Step G'-14: "1" is added to the quick-attenuation channel number "DPNUM" to thereby effect an incremental increase thereof.

Figure 10:
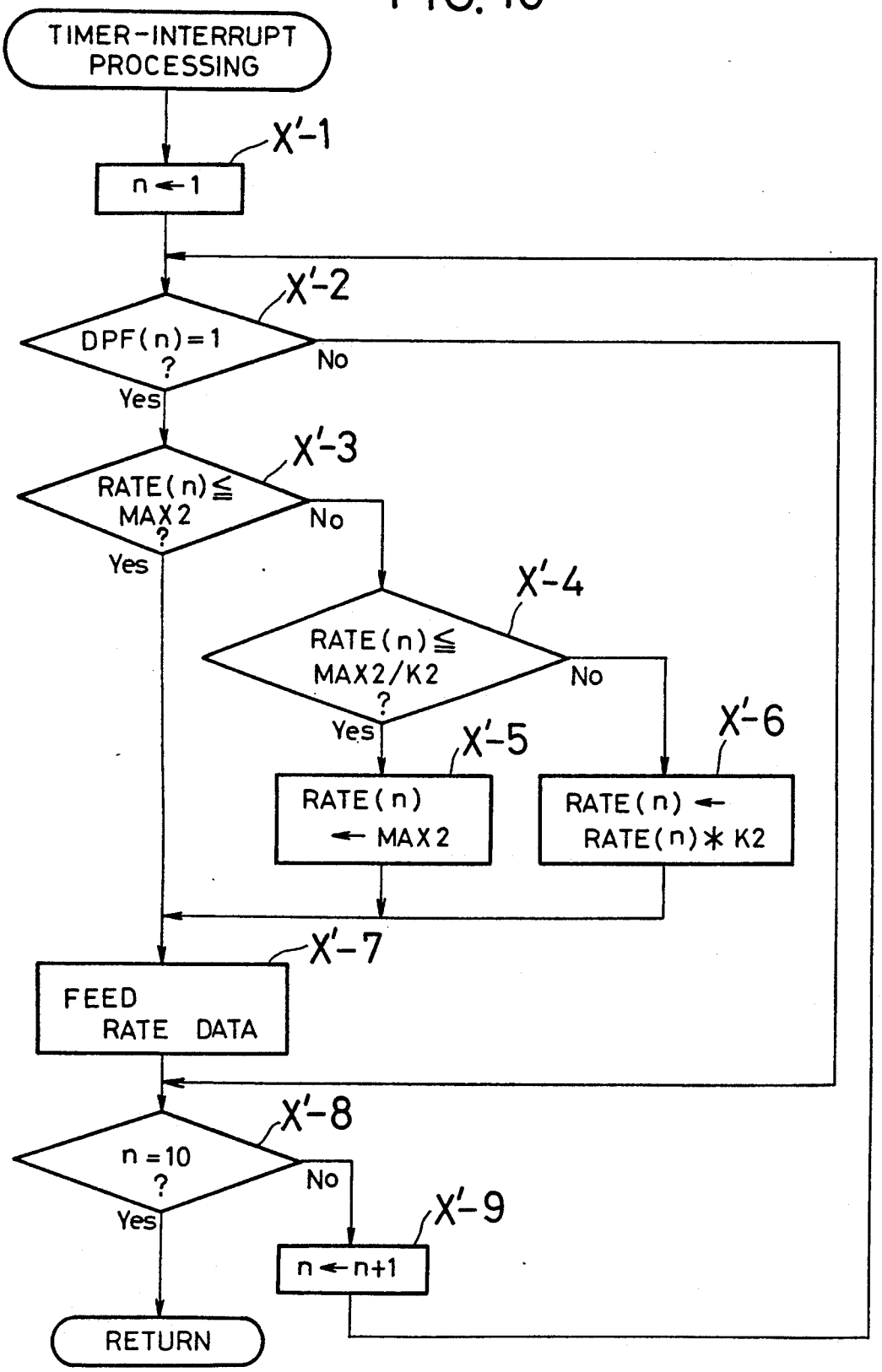

() Timer-Interrupt Routine ( FIG. 10** )

Step X'-1: "1" is set to a channel number "n" which represents the ordinal numbers of the channel pairs.

Step X'-2: A decision is made as to whether or not a value carried by the flag "DPF(n)" which corresponds to the channel number "n" and is written on the channel table (shown in FIG. 3A) is "1". This means that a decision on whether the channel pair of the channel number "n" is or is not undergoing quick-attenuation.

Step X'-3: If there is a "Yes" at the decision made at Step X'-2, a further decision is made as to whether a current negative rate, which is given as a rate-of-change "RATE(n)" of the envelope signal for the channel pair corresponding to the channel "n" on the channel table shown in FIG. 3A, is or is not either equal to or less than a secondarily-modified negative rate "MAX2" which has previously been set at "−40". The current negative rate given as the rate-of-change "RATE(n)" referred to at this Step X'-3 and at the next Step X'-4 is not an "absolute" value but a "real" number.

Step X'-4: If there is a "No" at the decision made at Step X'3, then a further decision is made as to whether said rate-of-change "RATE(n)" is or is not either equal to or less than a quotient of "MAX2" divided by a secondary acceleration coefficient "K2" which has previously set at "2".

Step X'-5: If there is a "Yes" at the further decision made at Step X'-4, then the secondary attenuation rate "MAX2" (i.e., −40) is written in an area for the rate-of-change "RATE(n)" which will be found on the channel table in FIG. 3A for the channel "n".

Step X'-6: If there is a "No" at the further decision made at Step X'-4, then a product of the secondary acceleration coefficient "K2" (i.e., 2) and the rate-of-change "RATE(n)" corresponding to the channel "n", is written in the are for the "RATE(n)" on the channel table in FIG. 3A.

Step X'-7: The rate-of-change "RATE(n)" which is found on the channel table in FIG. 3A in correspondence with the channel "n" is given, as the negative rate for attenuation of envelope signal, to a relevant envelope generating channel in the envelope generating circuit 25.

Step X'-8: A still further decision is made on whether the channel number "n" is or is not equal to "10", i.e., the total number of channel pairs.

Step X'-9: If there is a "No" at the decision made at Step X'8, then "1" is added to said channel number "n" so as to effect an incremental increase thereof.

The timer-interrupt processing described above is such that the rate-of-change "RATE(n)" of the envelope signal for each channel pair undergoing a quick-attenuation processing is compared, stepwise at regular time intervals, with said secondarily-modified negative rate "MAX2" (i.e., −40) and with a quotient thereof divided by said secondary acceleration coefficient "K2" (i.e., 2). It will also be understood that such a processing enables selection of the greatest negative rate for the attenuation process as the rate of change "RAGE(n)" which is effective at the start of the quick-attention process whereby the fastest acceleration is imparted thereto without bringing about any noticeable click noise or remarkable increase thereof. In other words, the progress of attenuation of the envelope signal level is gradually accelerated with the lapse of time.

[Third Embodiment]

According to the third embodiment, there are utilized not only the envelope signals but also other characteristics of musical tones which are being generated whereas the first and second embodiments rely only on the envelope signals in setting the negative rate thereof for the quick-attenuation processing. As a result, the third embodiment affords more adequate and more accelerated quick attenuation. The attenuation process in the third embodiment may be represented by a straight line graph because any timer-interrupt routine is not employed here for the sake of simpler description. However, it is a matter of course that such routine can be involved resulting in a polygonal line graph as in FIG. 8 for the foregoing embodiments. Thus, only a quick-attenuation routine will be described below wherein the same symbols and numerals as those in the foregoing embodiments denote the same or corresponding members or parts, and description of such features that are common to this and the foregoing embodiments is not repeated.

Figure 11:
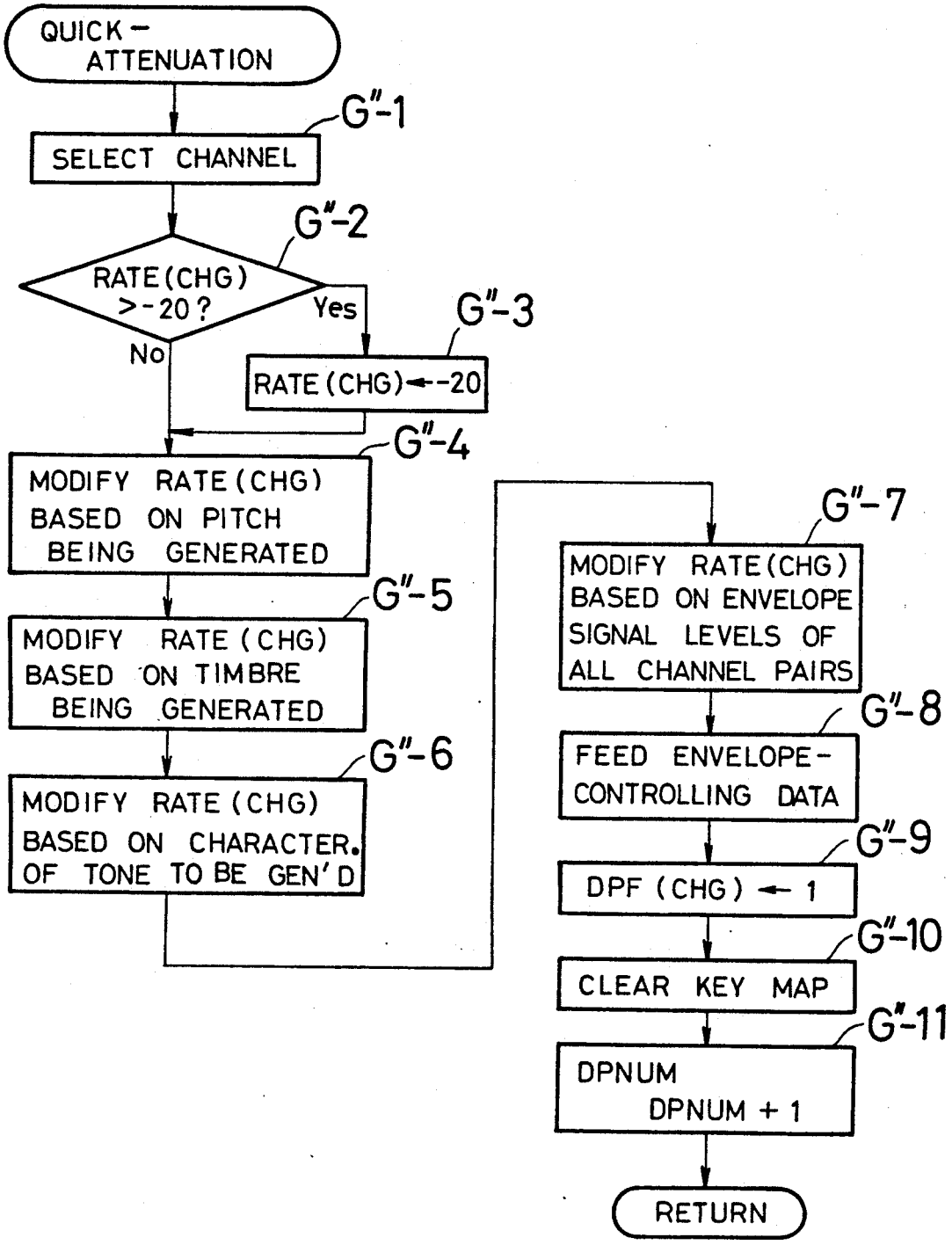

(*) Quick-Attenuation Routine ( FIG. 11 )

Step G''-1: In a case where any channel pairs for which "0" appears on relevant flags "DPF(1)" to "DPF(10)" indicating that said channel pairs are not undergoing quick-attenuation, levels "LEVEL" of the envelope signals for said channel pairs are read from the envelope generating circuit 25. One channel pair which has a minimum value of the level "LEVEL" is selected to be subject to quick-attenuation. Then, a channel number "CHG" is given to the selected channel.

Step G''-2: A decision is made as to whether a current rate-of-change "RATE(CHG)" of the envelope signal as shown in FIG. 3A for the channel pair corresponding to the selected channel "CHG" is or is not greater than "−20".

Step G''-3: If there is a "Yes" at the decision made at step G''-2, then "−20" is written, as a new negative rate for the channel "CHG", in the area for the "RATE(CHG)" on the channel table shown in FIG. 3A.

Step G''-4: Reference is made to a "key-numbers to rate-modifying coefficients" table (stored in the ROM 22B and hereinafter referred to as "table KNMC") by means of a key number "KN" representing a musical tone which is being generated in the channel pair of the selected channel "CHG". A value obtained by reference to the table "KNMC" is multiplied by the "RATE(CHG)" mentioned at Steps G''-2 and G''-3, to give a product which is adopted as a new rate-of-change "RATE(CHG)" for the channel pair.

(#1) Table "KNMC"

Figure 12:
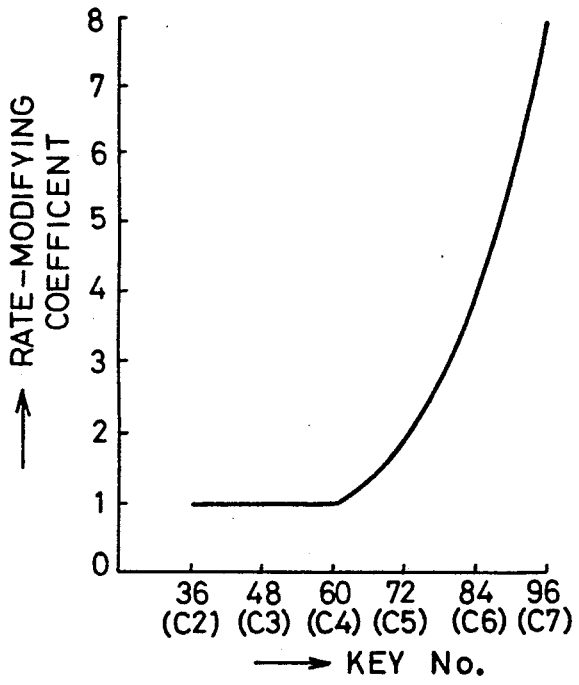

This table (i.e., "key-numbers to rate-modifying coefficients" table ) is so composed that optimum negative rates for the attenuation process are allotted to respective musical pitches of tones which are being generated. As is illustrated in FIG. 12, rate-modifying coefficients are listed on the table for respective key numbers "KN". The axis of the abscissas gives the key numbers "KN" with parenthesized musical pitches, while the axis of the ordinates gives the coefficients used to modify negative rates for attenuation process.

The table "KNMC" contains such coefficients for the compass covering the pitch "C2" to "C7" which can be generated by the electronic musical instrument in the invention, as follows.

(#1—1) For C2 to C4

A constant value "1" is listed for all of the pitches falling within this range so that the lower attenuation rate may not excessively retard attenuation of lower sounds and may not prolong a time necessary for completion of attenuation thereof.

(#1-2) For C4 to C7

In this zone of the table, pitches (i.e., frequencies) of respective keys are given as ratios thereof to the pitch (i.e., frequency) of the musical tone generated by the key "C4". For example, a key "C7" generates a musical tone whose pitch is 8 (eight) times the pitch of key "C4" so that "8" is listed on the table for said key "C7". The modifying of attenuation rates in proportion to the pitches which are being produced is based on a fact that the higher the pitch, the less noticeable is its click noise caused by quicker attenuation. Thus, musical tones of higher pitches can be attenuated quicker than those of lower pitches are. The table "KNMC" is useful in performing such a manner of attenuation control.

The key number "KN" of the musical tone which is being generated may be identified by searching the channel numbers on the key map. Alternatively, registers may be incorporated respectively for the channel pairs so that the key numbers "KN" are written in the registers when the tone generating data are generated at Step M. In this case, each written key number "KN" may be read from the relevant register when the channel pair is selected at Step G"-4.

Step G"-5: Next, reference is made to a "musical timbres to rate-modifying coefficients" table (stored in the ROM 22B and hereinafter referred to a "table MTMC") by means of a timbre of the musical tone which is being generated in the channel pair of the selected channel "CHG". A value obtained by reference to the table "MTMC" is multiplied by the rate-of-change "RATE(CHG)" obtained at Step G"-4, to give another product which is adopted as a new rate-of-change "RATE(CHG)" for the channel pair.

(#2) Table "MTMC"

This table (i.e., "musical timbres to rate-modifying coefficients" table ) is so composed that optimum negative rates for attenuation process are allotted to respective timbre characteristics or tone-color characteristics of musical tones which are being generated. As is illustrated in FIG. 13, rate-modifying coefficients are listed on the table for the respective timbres "A", "B", "C" and so on. Step G"-6: Further, selection of one of "depression speeds to rate-modifying coefficients" tables (stored for respective timbres in the ROM 22B and hereinafter referred to as "table DSMC") is made by means of a timbre of a musical tone which is to be newly generated. A value which will be obtained by reference to the selected table "DSMC" based on the depression speed "V", which is read from the temporary key data "KYDT" of the newly depressed key, is multiplied by the rate-of-change "RATE(CHG)" obtained at Step G"-5 for the selected channel "CHG" to thereby give a product which is adopted as a further-modified rate-of-change "RATE(CHG)" for the musical tone being produced.

(#3) Table "DSMC"

This table (i.e., "depression-speeds to rate-modifying coefficients" table) is used to search an optimum rate-modifying coefficient for attenuation of a current musical tone, based on parameters of a succeeding musical tone which is to be generated after the current musical tone has been attenuated. This table provides an interrelationship between optimum negative rates for attenuation of the current tones and characteristics of the succeeding tones. Said characteristics include timbre characteristics, positive leading or rising rates of "attack" parts constituting envelope curves of said newly generated tones and target volumes thereof.

This third embodiment makes use of a fact that, if the attack part of the newly generated tone produces a sudden and very loud sound, a click noise produced when the current tone is damped quickly becomes more unnoticeable. Therefore, in such a case, a greater negative rate can be employed to attenuate the envelope signal level of current musical tone.

Figure 14A:
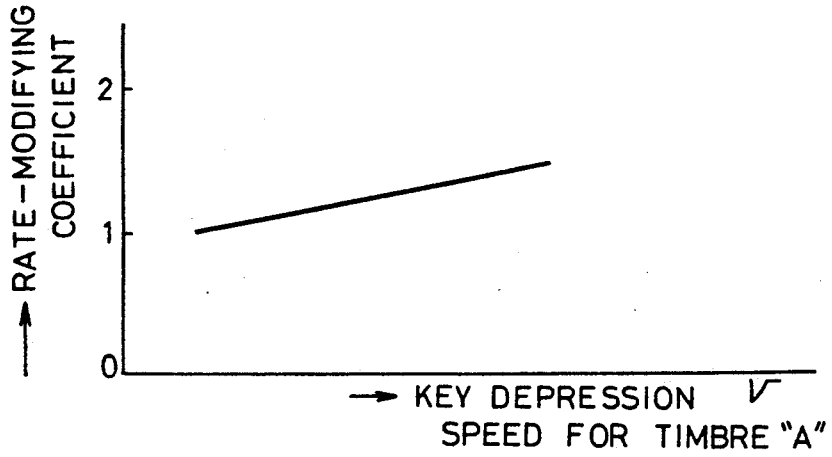
Figure 14B:
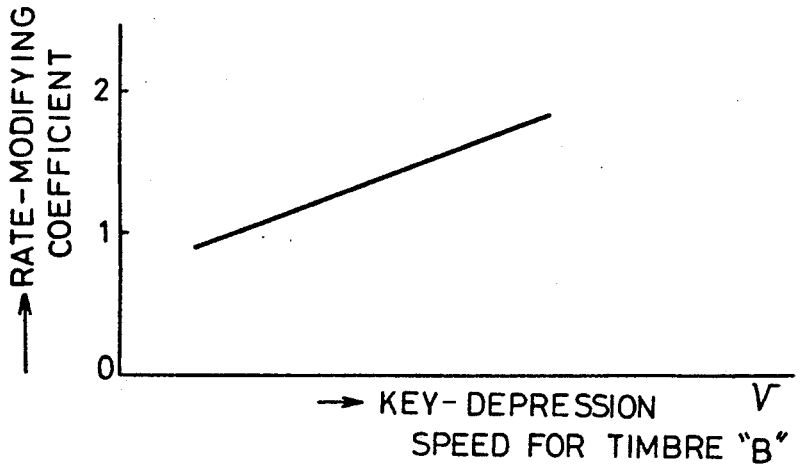

It is also to be noted that neither the relationship between key-depression speed and rate-of-change, nor relationship between key-depression speed and target volume nor the timbre-characteristics are fixed. These relationships and the timbre-characteristics are different for different timbres. Thus, respective tables of rate-modifying coefficients are provided for respective timbres. FIGS. 14A and 14B illustrate the tables for timbres "A" and "B", respectively.

Step G"-7: Current envelope signal levels "LEVEL" of all the channel pairs are read from the envelope generating circuit 25 and are summed up to give a total which is then divided by a value "700" to produce a quotient. A value "0.5" is added to the quotient whereby a further coefficient is obtained. The rate-of-change "RATE(CHG)" ( found on the channel table in FIG. 3A, corresponding to the selected channel "CHG") which has been modified at Step G"-6 is further modified here by multiplying it by the further coefficient mentioned above, This Step G"-7 is effective to employ the most optimum rate-of-change as the attenuation rate by taking a full account of the total volume of the musical tones which are being generated at that instant. If the total volume is sufficiently high, then the click noise is almost inaudible even at a remarkably high attenuation rate of envelope signals.

Step G"-8: The rate "RATE(CHG)" found on the channel table in FIG. 3A and corresponding to the selected channel "CHG" is given, as the negative rate data of envelope signal, to a relevant channel pair in the envelope generating circuit 25. Further, "0" as a target value of the envelope signal level is also given to said relevant channel pair in said circuit 25.

Step G"-9: A value "1" indicating quick-attenuation is written on an area in the channel table shown in FIG. 3A, the area being the flag "DPF(CHG)" which corresponds to the selected channel "CHG".

Step G"-10: A value "0" is written on an area in the key map shown in FIG. 3B, the thus cleared area being the channel number area which relates to a key corresponding to the selected channel "CHG".

Step G"-11: "1" is added to the quick-attenuation channel number "DPNUM" to thereby effect an incremental increase thereof.

[Fourth Embodiment]

In the first to third embodiments described above, selection of the channel pair which should undergo the quick-attenuation processing is made based merely on the current levels "LEVEL" of musical tones from all the channel pairs (see the Steps G-1, G'-1 and G''-1). From another aspect of the invention, however, it is more preferable to finish the attenuation process as soon as possible. The third embodiment does not necessarily meet this requirement because the attenuation rate is set according to the pitch and timbre characteristics of the musical tone which is to be quick-attenuated, and also according to the rate-of-change at the start of quick-attenuation. In other words, the channel pair which is producing the lowest level "LEVEL" of the envelope signal cannot always be attenuated within the shortest period of time.

The fourth embodiment can modify, for instance, the third embodiment from the aspect referred to above in such a manner that the rates-of-change "RATE(CHG)" (which are determined according to the pitches and timbre characteristics of generated tones, and also according to the rate-of-change at start of quick-attenuation) are used together with the current levels "LEVEL" of envelope signals so that the time lengths needed to finish the quick-attenuation processings for the respective channel pairs are calculated. The channel pair which has the shortest time length is thus selected to undergo the quick-attenuation processing.

The same symbols and numerals as those in the first to third embodiments denote the same or corresponding members or parts, and description of such features that are common to the embodiments is not repeated Here described is only a channel selecting processing which corresponds to Step G''-1 in the third embodiment.

Figure 15:
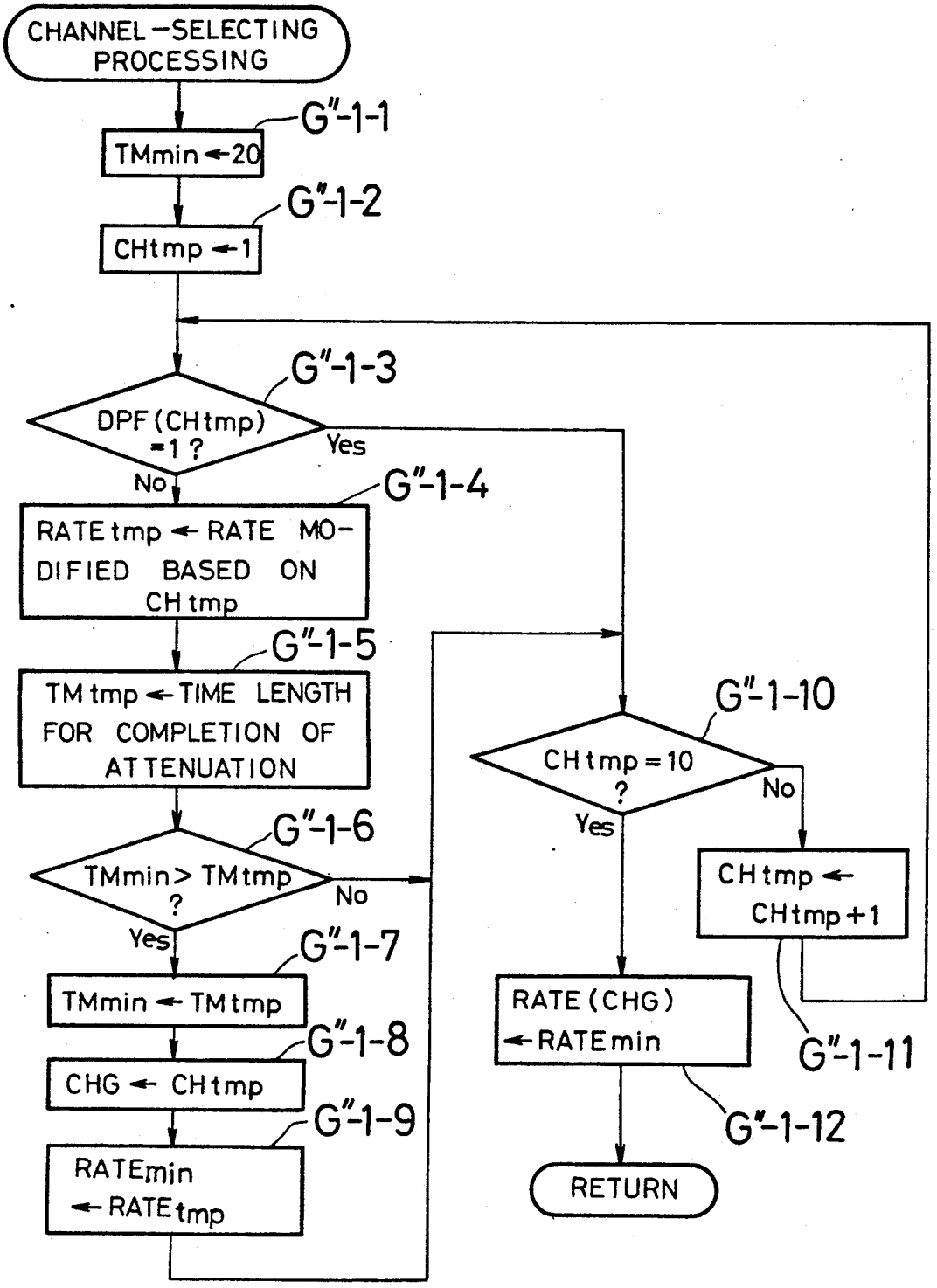
FIG. 15 is a flowchart of a channel-selecting routine relating to a fourth embodiment of the invention and corresponding to Step G"-1 in the quick-attenuation routine shown in FIG. 11.

(*) Channel Selecting Routine ( FIG. 15 )

Step G''-1-1: An initial value "20" is set to a register "TMmin" used for temporary storage of time. The shortest time length for finishing the attenuation processing is to be written to this register. The initial value "20" is higher than value corresponding to the longest possible time required for attenuation.

Step G''-1-2: "1" is set as a temporary channel number "CHtmp", on a register.

Step G''-1-3: A decision is made as to whether a flag "DPF(CHtmp)" corresponding to channel pair of the temporary channel number "CHtmp" on the channel table shown in FIG. 3A is or is not "1".

Step G''-1-4: If "No" at the decision made at Step G''-1-3, in other words, if the channel pair is not undergoing quick-attenuation, then a current rate-of-change "RATE(CHtmp)" is found on the channel table shown in FIG. 3A, corresponding to the temporary channel number "CH(tmp)". Further, pitch and timbre characteristics of the musical tone which is being generated by the channel pair "CH(tmp)" are found so as to be used together with the current rate-of-change "RATE(CHtmp)" in a procedure comprising some steps similar to Steps G''-2 to G''-5 in the third embodiment whereby a modified negative rate as a temporary negative rate "RATEtmp" is obtained Step G''-1-5 A current level "LEVEL" of envelope signal produced by the temporary channel "CHtmp" is divided by the temporary negative rate "RATEtmp", thereby producing a temporary time length "TMtmp" which is a current time length to finish the attenuation processing Step G''-1-6 A further decision is made as to whether the time length "TMmin" is or is not longer than the temporary TMtmp".

Step G''-1-7: If "Yes", then the temporary "TMmin" is written in the register for the time length "TMmin".

Step G''-1-8: Next, the temporary channel "CHtmp" is substituted for the selected channel number "CHG".

Step G''-1-9: The temporary negative rate "RATEtmp" obtained at Step G''-1-4 is defined to be a negative rate "RATEmin".

Step G''-1-10: A still further decision is made as to whether the temporary channel "CHtmp" is or is not "10" which is the total number of channel pairs.

Step G''-1-11: If there is a "No" at the decision made at Step G''-1-10, then "1" is added to the temporary channel "CHtmp" for increment thereof.

Step G''-1-12: If there is a "Yes" at the decision made at Step G''-1-10, then the negative rate "RATEmin" is substituted for the rate-of-change "RATE(CHG)" on the channel table in FIG. 3A.

As described above, the channel "CHG" for which attenuation takes the shortest time is selected and the rate-of-change "RATE(CHG)" thereof is accordingly obtained at the attenuation rate. After that, a processing similar to the Steps G''-6 to G''-11 as in the third embodiment is performed to determine a more appropriate negative rate which improves control of the envelope signals in attenuation process.

The first to fourth embodiments may be applicable to certain cases other than the described instances wherein any current musical tone becomes unnecessary due to a change in timbre during the playing of music, or wherein there is left free no channel pair allottable to a new key-depression, thus requiring quick-attenuation. For example, said embodiments are useful in quickly attenuating a musical tone which is being generated according to a previous key-depression, so that another musical tone of the same pitch can be generated through a different channel pair when the same key is consecutively struck. Further, some of musical tones which are being generated by previous key-depressions may be attenuated in the so-called "MONO-mode" in the already described manner in order that only one of musical tones caused by plural simultaneous key-depressions can be preferred in said MONO-mode.

Target values of envelope signal levels may be obtained in the first to fourth embodiments on the basis of the levels which will be detected at the start of the quick-attenuation processing, or may be changed during said processing based on the current level of the envelope signal.

Both a target level of the envelope signal and a negative rate for the attenuation process may be changed every time when envelope signal level has reached the target value during said process, although only the negative rate is altered at regular intervals of 2 (two) milliseconds with the target level maintained at 0 (zero) in the first to fourth embodiments. The regular time intervals per se may be changed during said process.

The negative rate for attenuation of envelope signals may be obtained based on such parameters which determine the timbre characteristic and control the musical tone-generating circuit 24, although in the third embodiments the numeral data are previously given for each timbre and are used as the timbre characteristic data determining the negative rate for attenuation of the envelope signals during the quick-attenuation process. In detail, parameters of a filter by which the musical tone-generating circuit 24 controls a content of higher-frequency components in the musical tones may be used to set the negative rate for attenuation of envelope signals.

Further, said negative rate for the attenuation of envelope signals may be set in a direct manner based on parameters (such as a timbre-controlling parameter, a positive leading rate of the envelope signal attack part and a target level of said signal) which control a new musical tone to be generated, although in the embodiments the speed of a new key-depression is used as the characteristic used to set said negative rate. In this case, the quick-attenuation process may be started with a given negative rate for the attenuation process which is provided without taking account of the new musical tone characteristic, wherein a tone-generating data is obtained at the same time and then used in the timer-interrupt processing in order to accelerate the attenuation process for envelope signals.

The negative rate for attenuation of envelope signals may be set in correspondence with the pitch, instead of relying on such musical tone characteristics as the timbre, the positive leading rate of the envelope signal attack part and the target level of said signal which are utilized, in the first to fourth embodiments, to set the negative rate for the quick-attenuation process.

It is also possible to forcibly and instantly cause the envelope signal level to become 0 (zero) for generation of a new musical tone, although the end of attenuation is to be detected in the first to fourth embodiments by deciding whether and when the level has become "0" as a result of a predetermined process. This modification will slightly increase the click noise, but the time length required for attenuation can be shortened to a considerable degree. There are some options in execution of this modification, one of them being a manner in which a predetermined level higher than "0" is regarded as "0", and the other option being another manner wherein a predetermined length of time which has elapsed after the start of quick-attenuation is regarded as the end of quick-attenuation. It is of course that the predetermined level or the predetermined time length may be selected based on the characteristics of musical tones which are being or are to be generated, or based on the total volume of musical tones which are being generated, to thereby suppress the click noise.

The third embodiment, in which the negative rate for the attenuation process is set on the basis of the total volume of musical tones which are being generated, may be modified such that also the pitches and timbres of the musical tones are taken into account in addition to said volume as the measure used when setting the negative rate.

In a case wherein each musical tone is composed of plural tone components which are respectively allotted to plural channel pairs operating simultaneously to generate said components, some characteristics (e.g., pitches, timbre characteristics, rate-of-change of envelope signal levels and target values thereof) may be used to set the negative rate for quick attenuation.

As to the waveform of quick-attenuated envelope signals, certain different types such as attenuating portions of squaresine wave (i.e., Hanning window) or Gaussian window may be employed advantageously as a basic waveform because they can prevent the spectrum of the envelope signals from broadening. The envelope generating circuit 25 may be of such a structure that necessary waveform memories are read therein. With this kind of circuit 25, it is possible either to employ envelope data of a special waveform which are used exclusively for quick-attenuation and to which changeover is done from usual envelope data when quick-attenuation is performed, or to employ envelope-generating means of a special type which can produce the abovementioned waveforms for the envelope signals.

Control of the musical tones under quick-attenuation need not to be limited to control of musical tone amplitudes as in the first to fourth embodiments, but may also be directed additionally to the contents of higher-frequency components during the quick-attenuation processing.

The rate-of-change is defined, in the first to fourth embodiments, as a change per unit time in the level of the envelope signal. However, any other parameter which can represent sharpness of change in said level in the course of time may be employed as the rate-of-change, and for example, the time constant can be the rate-of-change if the intensity of the envelope signal changes along an exponential curve.

Furthermore, certain "conditions" of the channel pairs which are generating musical tones may be taken into account in the channel-selecting processing when one pair is selected, from said pairs, to be subject to quick-attenuation and then allotted to a new key-depression, although the first to fourth embodiments are not constructed to do so. The channel pairs may, for example, be tested to see whether they do or do not correspond to such keys that were already released. Any channel pairs for the already released keys are preferentially selected, and then a further selection is made to find out one channel pair generating a musical tone which is attenuated within the shortest period of time. Another criterion for preference is the phase of envelope signal waveform. In detail, those channel pairs which have not yet completed the attack part of the waveform when the channel-selecting processing is performed are not preferred, but the other ones which are producing envelope signals following the attack part are selected to be subject to quick-attenuation. Envelope signals of the "piano" type have their highest level of intensity at the attack part and then gradually decay, after having passed said part. In view of this nature, those channel pairs which are producing said signals below their maximum level are not selected.

What is claimed is:

1. An envelope-generating apparatus in an electronic musical instrument, the envelope-generating apparatus being adapted to generate an envelope signal for a musical tone and comprising:

(a) rate detecting means for detecting an actual rate-of-change of the envelope signal at an instant before quick-attenuation of a musical tone commences; and (b) quick-attenuation controlling means for setting a predetermined rate for attenuation of the envelope signal for the musical tone based on the actual rate-of-change detected by the rate detecting means and for controlling quick-attenuation of the envelope signal.

2. An envelope-generating apparatus as set forth in claim 1, further comprising:

level detecting means for detecting an actual level of the envelope signal at an instant before quick-attenuation commences, the quick-attenuation controlling means setting the predetermined rate for attenuation such that quick-attenuation of the envelope signal is accelerated if the actual level detected by the level detecting means is lower than a reference level.

3. An envelope-generating apparatus in an electronic musical instrument, the envelope-generating apparatus being adapted to generate an envelope signal for a musical tone and comprising:

(a) musical pitch-detecting means for detecting an actual musical pitch of a musical tone which is being generated; and (b) quick-attenuation controlling means for setting a predetermined rate for attenuation of the envelope signal corresponding to the musical tone being generated such that quick-attenuation of a level of the envelope signal is accelerated if the actual musical pitch of the tone being generated is higher than a reference pitch.

4. An envelope-generating apparatus in an electronic musical instrument, the envelope-generating apparatus being adapted to generate an envelope signal for a musical tone and comprising:

(a) characteristic-detecting means for detecting characteristics of a new musical tone to be generated; and (b) quick-attenuation controlling means for setting a predetermined rate for attenuation of the envelope signal based on the characteristics detected by the characteristic-detecting means.

5. An envelope-generating apparatus as set forth in claim 4 wherein the characteristics are at least one selected from a group consisting of pitch, timbre characteristics, a positive leading rate of an attack part of the envelope signal and a generated volume target value.

6. An envelope-generating apparatus in an electronic musical instrument, the envelope-generating apparatus being adapted to generate an envelope signal for a musical tone and comprising:

(a) musical volume-detecting means for detecting an actual total volume of all musical tones which are being generated by the apparatus; and (b) quick-attenuation controlling means for setting a predetermined rate for attenuation of a level of the envelope signal based upon the total musical tone volume detected by the detecting means such that the higher the detected actual total volume, the quicker the level of the envelope signal is attenuated.

7. An envelope-generating apparatus as set forth in claims 1, 2, 3, 4, 5 or 6 wherein the quick-attenuation controlling means is adapted to repeatedly replace a current predetermined rate with a greater attenuation rate in such a manner that quick-attenuation of the envelope signal is gradually accelerated in time.

8. An electronic musical instrument which comprises a plurality of musical channels and is so constructed that at least one of the channels can be selected for generation of a new musical tone even as all the musical channels are generating musical tones, the electronic musical instrument comprising:

(a) characteristic-detecting means for detecting characteristics of musical tones which are being generated respectively by the musical channels;

(b) rate searching means for searching rates for attenuation of the envelope signals of said musical tones based on the characteristics thereof detected by the characteristics-detecting means;

(c) time determining time lengths required for attenuation of the respective musical tones based on rates searched by the rate searching means; and (d) channel selecting means for selecting one of the musical channels according to which channel is judged to be generating a musical tone having a shortest attenuation time length based on the time lengths determined by the time determining means.

9. An electronic musical instrument as set forth in claim 8 wherein the musical channels are channel pairs each comprising one musical tone-generating channel and one envelope generating channel.

* * * * *